US005540024A

United States Patent [19]

Stalford

[11] Patent Number: 5,540,024

[45] Date of Patent: Jul. 30, 1996

[54] FLOOR SYSTEM AND METHOD FOR CONSTRUCTING SAME

[76] Inventor: Alvin H. Stalford, 7218 Holyoke, Dallas, Tex. 75248

[21] Appl. No.: 461,051

[22] Filed: Jun. 5, 1995

[51] Int. Cl.[6] ..... E04B 5/00; E04F 13/08

[52] U.S. Cl. ..... 52/390; 52/403.1; 52/480

[58] Field of Search ..... 52/403.1, 408, 52/480, 483.1, 390, 393, 508

[56] References Cited

U.S. PATENT DOCUMENTS

| | | | |
|---|---|---|---|
| 1,407,679 | 2/1922 | Ruthrauff | 52/480 |
| 2,069,755 | 2/1937 | Foster | 52/403.1 X |
| 2,115,238 | 4/1938 | Stevens | 52/403.1 |
| 2,167,696 | 8/1939 | Tetzman | 52/403.1 X |
| 3,387,422 | 6/1968 | Wanzer | 52/403.1 X |
| 3,518,800 | 7/1970 | Tank | 52/480 |
| 4,589,243 | 5/1986 | Abendroth | 52/480 X |
| 4,682,459 | 7/1987 | Stephenson | 52/390 |
| 4,930,280 | 6/1990 | Abendreth | 52/480 X |
| 4,995,210 | 2/1991 | Niese et al. | 52/391 |
| 5,299,401 | 4/1994 | Shelton | 52/403.1 X |

*Primary Examiner*—Carl D. Friedman
*Assistant Examiner*—Robert J. Canfield
*Attorney, Agent, or Firm*—J. Kevin Gray

[57] ABSTRACT

A hardwood flooring system includes an upper layer of hardwood components and a subflooring unit composed of one or more layers of non-wood materials. One or more membranes separate the subflooring unit from the base material upon which the floor is installed and the upper hardwood layer, preventing the introduction of moisture to the vulnerable wood components of the upper layer from any layer below it. The relative positioning of the sublayer with respect to the upper layer and with respect to components of the sublayer, if more than one, acts to reduce or eliminate the damaging effects of negative forces experienced by the sublayers.

15 Claims, 4 Drawing Sheets

FLOOR SYSTEM AND METHOD FOR CONSTRUCTING SAME

TECHNICAL FIELD

The present invention relates to flooring systems, and more specifically, to hardwood flooring systems including a sealed, non-wood sublayer which reduces the negative effects of horizontal forces and protects against damage from moisture.

BACKGROUND OF THE INVENTION

Due to the natural beauty, durability and uniform resilience of hardwood flooring, it is routinely used in applications as diverse as upscale residential and commercial spaces to auditorium stages, dance floors and athletic surfaces. Gyms and sports arenas for basketball, volleyball, gymnastics, ballroom dance, racquetball, squash, etc., typically employ flooring systems comprised of hardwoods.

Traditionally, such hardwood floors have been constructed of one or more layers of wood strips or squares placed in a desired arrangement over a base material such as concrete, asphalt or another wood floor surface. The strips or squares can be fitted together in one of several ways. A common method employed is to secure the wood components using a tongue and groove mechanism. According to this method, the strips or squares of wood are milled or otherwise constructed to have alternating tongues and grooves such that when they are laid along side one another, they fit together. Depending upon the system, the floor components can be further secured through adhesives, nails and the like.

One problem associated with all flooring systems including wood is the negative effects of water and moisture. Since woods naturally absorb moisture, the wood flooring components expand in response to exposure to moisture and contract when such moisture is eliminated, invariably warping, buckling or otherwise deforming the system. Even a small amount of exposure to moisture in an isolated area of the flooring system can severely damage the integrity of the entire system since the components are typically linked in some manner. The horizontal and vertical stresses introduced by exposure to or removal of moisture are communicated through the flooring system, often resulting in widespread damage.

Accordingly, wood flooring systems employing protective coatings, air flow systems, drain channels, etc., have been developed to combat the above-identified damage from moisture. Unfortunately, a number of disadvantages exist with these prior art attempts, resulting in only a modicum of success at reducing such damage. For example, while systems including a drain channel are capable of rapidly removing a large amount of water from the flooring system, for example in a flooding situation, even small amounts and minimal length of exposure to such small amounts of water can result in severe damage. Indeed, just the humidity ever-present in the air in most geographical areas can result in the above-identified moisture damage.

Likewise, systems including protective coatings for the wood components often compromise the natural and desired characteristics of the wood and greatly increase the expense of the flooring system. Systems including an air-flow system are complicated and expensive to manufacture, install and maintain.

Recently, flooring systems including a "free-floating" support layer or layers of wood have been used in an effort to reduce moisture damage. The theory behind these flooring systems is that if the support layer is not rigidly secured to the upper layer (i.e., the upper layer "floats" over the support layer), stresses experienced by the support layer are not as likely to be communicated to the upper layer and thus damage to the upper layer will be reduced. An example of such a flooring system is disclosed in U.S. Pat. No. 4,995,210 to Niese. While these systems are partially successful in reducing the damage the upper floor layer will ultimately sustain, the upper layer still is subject to some moisture damage and the support layer remains completely subject to the destructive forces of moisture damage. As moisture damage occurs over and over again over time, there is a tendency for the support layer to have a greater and greater damaging effect on the upper layer. Accordingly, these flooring systems tend only to prolong the time it takes for moisture damage to appear in the upper layer of the floor.

Thus the need remains for a flooring system having the desired characteristics of hardwood components as well as an effective, inexpensive and practical way in which to permanently avoid the damage associated with moisture.

SUMMARY OF THE INVENTION

The flooring system of the present invention overcomes the foregoing and other problems associated with the prior art by providing a flooring system including an upper layer of hardwood flooring components and a single or multi-layered subflooring unit composed of non-wood materials. Additionally, membranes separate the subflooring unit from the base material and the subflooring unit from the upper hardwood layer, preventing the introduction of moisture existing at any level below it.

The present invention flooring system provides a flooring system having an upper layer composed of hardwood components, a subflooring unit composed of one or more layers of non-wood materials and one or more membranes located between the base material and the subflooring unit and between the upper layer and the subflooring unit, in effect sealing off the upper floor layer from any moisture existing below it. Since the subflooring unit is composed of non-wood materials, there is no concern that dry rot will result from the limited air flow available to the subflooring unit.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE DRAWINGS

Figure 1:
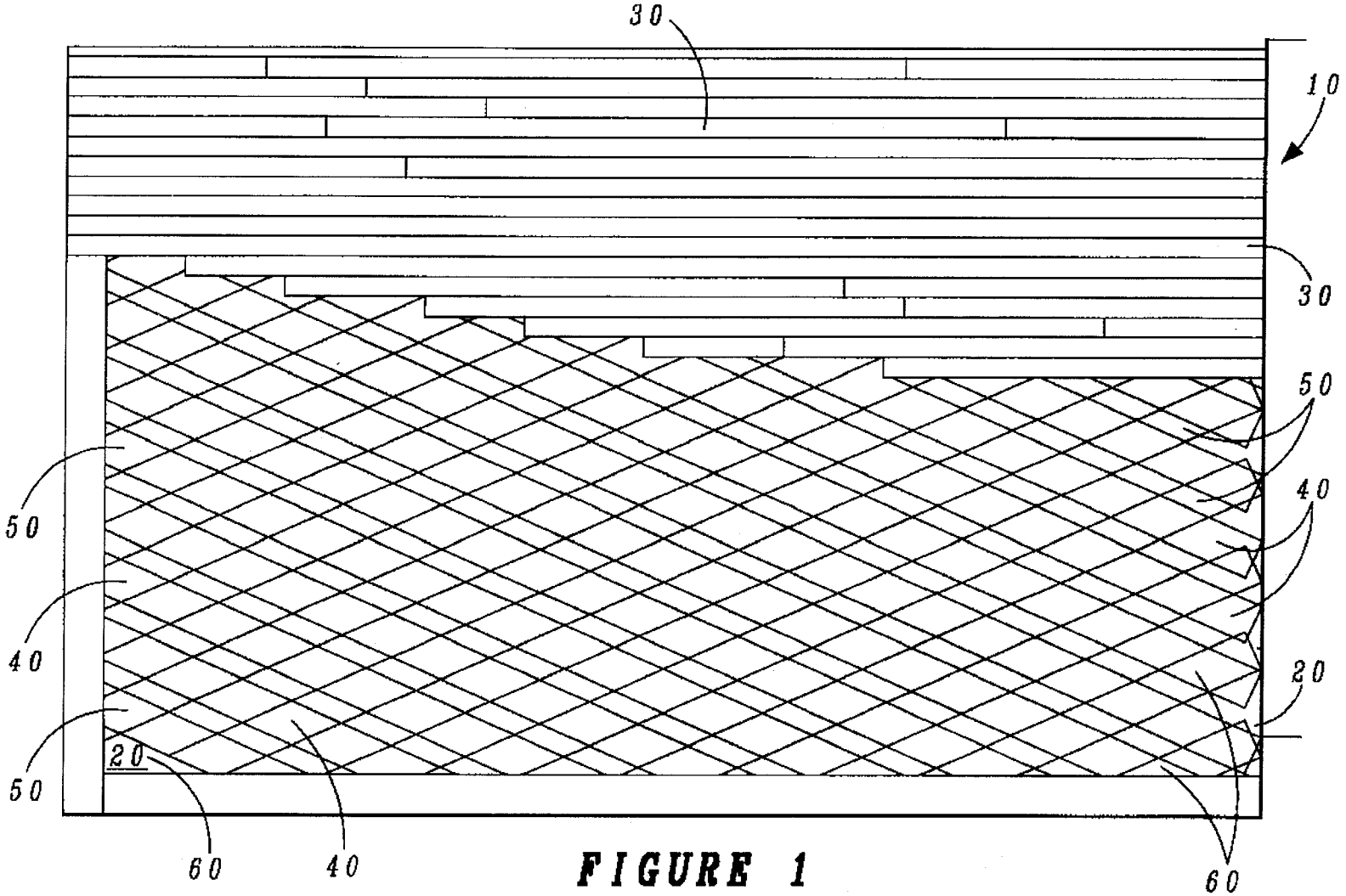
FIG. 1 is a top view of an embodiment of the flooring system of the present invention.

Referring to the FIGURES, wherein like elements have like reference numerals, FIG. 1 is a top view of an embodiment of the present invention flooring system 10. The flooring system of the present invention is preferably laid over a base material 20 such as a concrete slab, an old flooring system or surface, or similar smooth surface. The primary components of the present invention flooring system 10 include an upper layer 30 of hard wood materials, an upper sublayer 40 of non-wood material, a lower sublayer 50 of non-wood material and one or more membranes 60. Although a sublayer composed of two layers is described, a sublayer unit of a single layer or more than two layers can be used, if desired.

Figure 2:
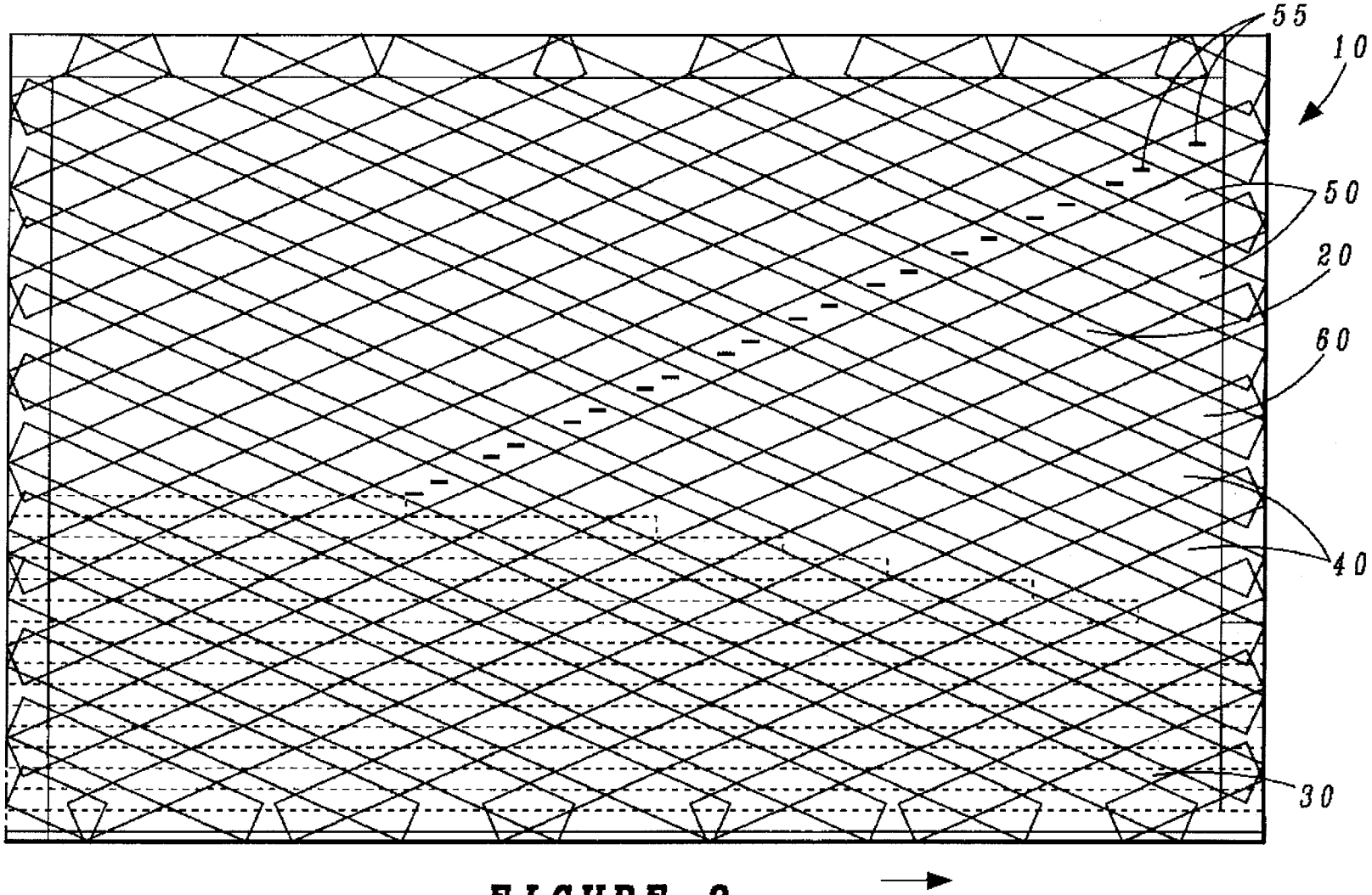
FIG. 2 is a top view of an embodiment of the flooring system of the present invention, illustrating the placement of the several layers of the system.

As seen in FIG. 2, the several layers of the present flooring system 10 are placed at certain angles with respect to each other to minimize the effects of negative forces experienced by the different layers and the communication of such forces adjacent layers, thus maximizing the longevity of the flooring system 10. The positioning of the several layers of the flooring system 10 is determined by selecting a desired horizontal direction (indicated by an arrow in FIG. 2) of the upper layer 30. Once this direction is determined, one or more membranes 60 are placed over the base material 20. The lower sublayer 50 is placed over the one or membranes 60. The lower sublayer is placed at a negative 22 degree angle from the ultimate direction (indicated by an arrow in FIG. 2) of the upper layer 30 of the flooring system 10. The upper sublayer 40 is placed over the lower sublayer 50 at a positive 22 degree angle from the ultimate direction (indicated by an arrow in FIG. 2) of the upper layer 30 of the flooring system 10. The upper layer 30 is placed over the upper sublayer 40 such that the direction of the boards or wood components of the upper layer 30 are in the desired placement. One or more membranes 60 are placed between the upper layer 30 and the upper sublayer 40.

Although the lower sublayer 50 and the upper sublayer 40 described above are preferably placed at a negative 22 degree angle and a positive 20 degree angle from the desired horizontal direction of the upper layer, respectively, any appropriate angle which reduces the effect of forces being passed from layer to layer can be used, if desired.

The upper sublayer 40 and lower sublayer 50 of the flooring system 10 are secured to each other using staples 55, glues, adhesives or the like. The secured sublayer is not secured either to the base material 20 or the upper layer 30. Once secured, the upper sublayer 40 and lower sublayer 50 act as a single layer. The relative directional positions of the sublayers optimally reduce the damaging effects of stresses, strains and other forces experienced by the flooring system 10 over time and during use.

Importantly, the upper sublayer 40 and the lower sublayer 50 are composed of non-wood materials. Non-wood sublayers not only eliminate the negative forces experienced by the natural tendency of wood to expand and contract with the addition and loss of water from humidity, flooding, etc., but also allow the sublayers to be sealed off from the other layers of the flooring system 10 by the membranes 60, providing additional protection of the upper layer 30 from the effects of water otherwise introduced from below. For example, in a situation where flooding introduces water to the base material level of a flooring system, the one or more membranes 60 positioned between the base material 20 and the lower sublayer 50, as well as the one or more membranes placed between the upper sublayer 40 and the upper layer 30, will protect the most vulnerable layer, the upper layer 30, from the water. Subfloor layers composed of wood cannot be sealed off in this fashion since they would experience dry rot. Thus, the present invention flooring system includes the desired beauty and natural durability of a wood upper layer, while removing the negative effects of water and forces on such desired surface.

Figure 3:
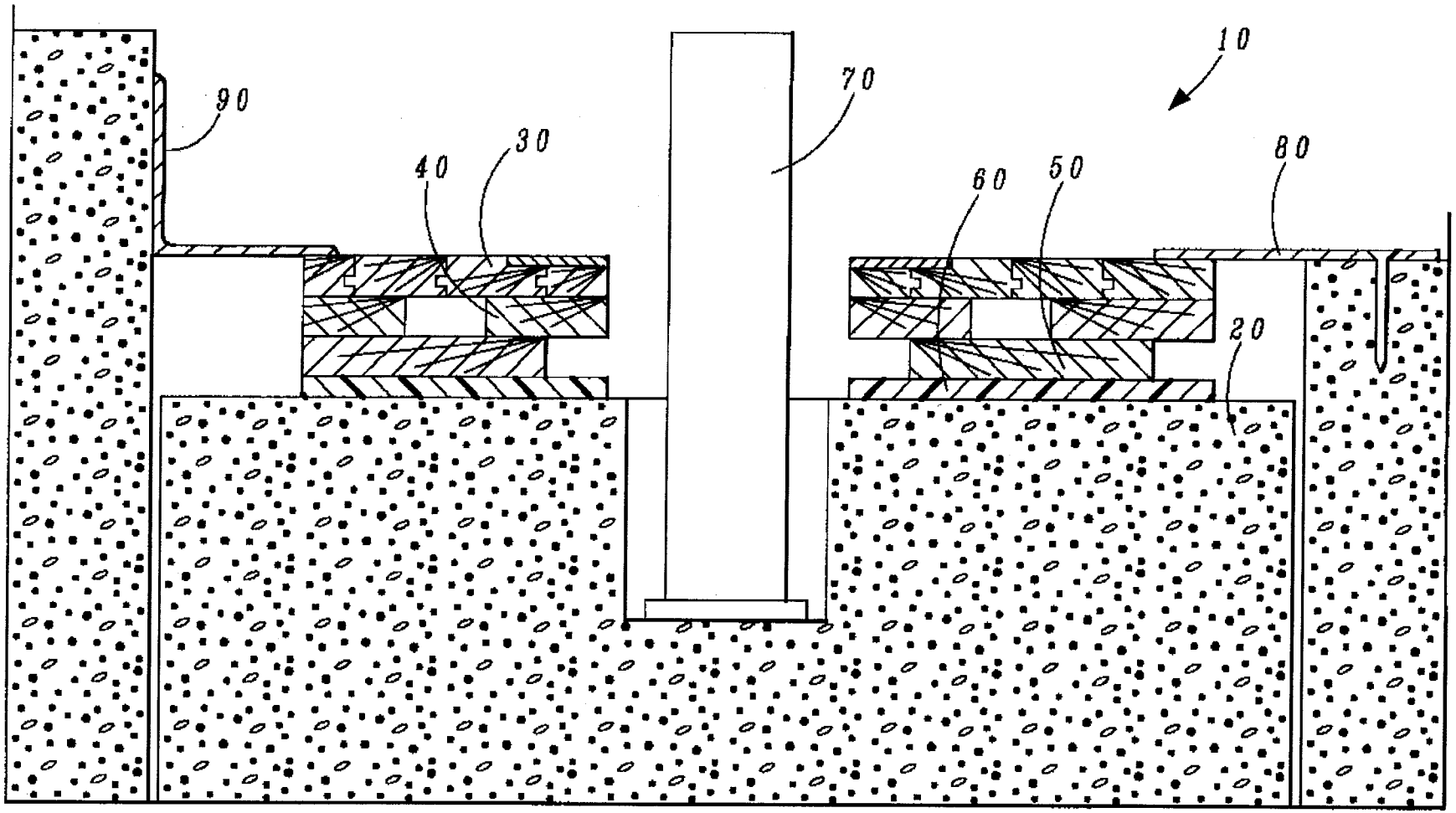
FIG. 3 is a side and cross section view of an embodiment of the flooring system of the present invention.

FIG. 3 illustrates an embodiment of the flooring system 10 of the present invention as installed to form the playing surface of a volleyball court. Although a volleyball court is illustrated, the flooring system of the present invention can be installed to form any suitable surface, such as basketball courts, racquetball courts, squash courts, dance floors, residential or commercial surfaces, etc. The base material 20 is a concrete slab. On the base material 20, a ¼ inch foam pad is placed as the membrane 60 between the base material 20 and the lower sublayer 50. This membrane 60 will seal the sublayers and, more importantly, the upper layer 30 from any water or moisture introduced via the base material 20. The lower sublayer 50 is placed over the membrane 60. Over the lower sublayer 50, the upper sublayer 40 is placed and secured to the lower sublayer 50 using staples (not shown). Finally, the upper layer 30, a maple flooring layer, is placed over the upper sublayer 40. A volleyball upright 70, aluminum threshold 80, vent cove base 90, etc., are then installed to facilitate use of the flooring system 10 as a volleyball court.

Figure 4:
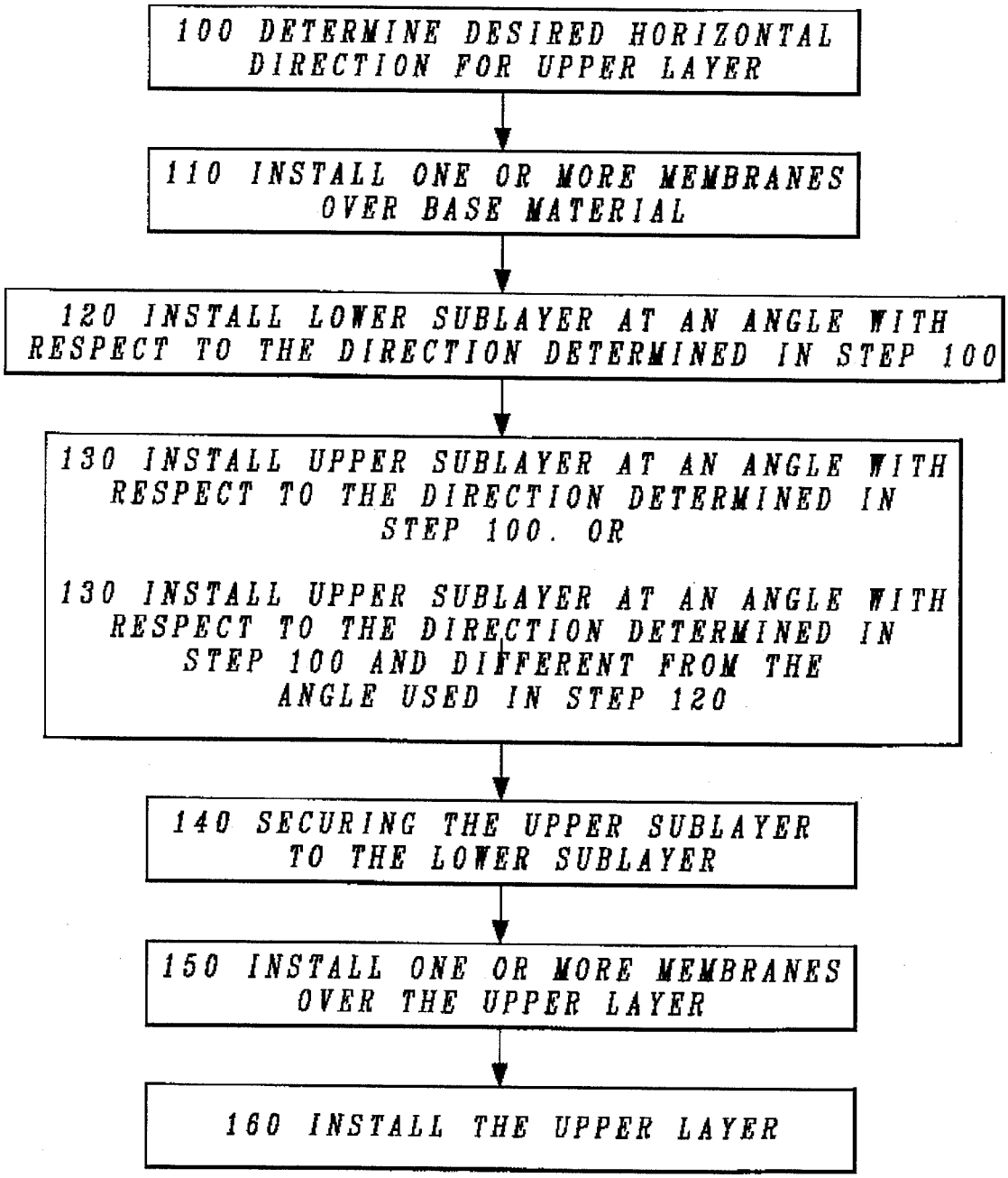
FIG. 4 is a flow chart illustrating the method steps for installing an embodiment of the flooring system of the present invention.

As illustrated in the flow chart of FIG. 4, a preferred method for installing the present invention flooring system comprises the steps of: (1) determining a desired horizontal direction for the wood components of the upper layer of the flooring system 100; (2) installing one or more membranes over a base material 110; (3) installing the lower sublayer at an angle with respect to the desired direction of the upper layer 120; (4) installing the upper sublayer at an angle different from the angle the lower sublayer was installed with respect to the desired direction of the upper layer 130; (5) securing the upper sublayer to the lower sublayer 140; (6) installing one or more membranes over the upper sublayer 150; and (7) installing an upper layer such that the components of the upper layer run at a desired direction 160.

Although the installation of the sublayers is disclosed using angles with respect to the desired horizontal direction of the upper layer and such angles are disclosed as differing from each other, the sublayers can be installed at any appropriate angle with respect to the desired horizontal direction of the upper layer and with respect to each other which will reduce or eliminate the effects of negative forces experienced by the sublayers.

Although preferred embodiments of the invention and method have been illustrated in the accompanying drawings and described in the foregoing Detailed Description, it will be understood that the invention is not limited to the embodiments and methods disclosed, but is capable of numerous rearrangements and modifications of parts and elements without departing from the spirit of the invention.

I claim:

1. A flooring system, comprising:

an upper layer composed of hardwood components;

an upper sublayer composed of a non-wood material;

a lower sublayer composed of a non-wood material;

said upper sublayer and said lower sublayer secured together to form a unitary sublayer;

at least one membrane located between the upper layer and the upper sublayer; and at least one membrane located between the lower sublayer and a base material.

2. The flooring system of claim 1, wherein the upper sublayer is placed at an angle with respect to a horizontal direction of the upper layer.

3. The flooring system of claim 2, wherein the angle is 22 degrees.

4. The flooring system of claim 1, wherein the lower sublayer is placed at an angle with respect to a horizontal direction of the upper sublayer.

5. The flooring system of claim 4, wherein the angle is 22 degrees.

6. The flooring system of claim 1, wherein the upper sublayer and the lower sublayer are placed at an angle with respect to a horizontal direction of the upper layer.

7. The flooring system of claim 1, wherein the upper sublayer and the lower sublayer are composed of a material from the group consisting of: rubber, plastic, composite material and polymers.

8. The flooring system of claim 1, wherein the upper sublayer and the lower sublayer are secured with staples.

9. A flooring system, comprising:

an upper layer composed of hardwood components;

a sublayer composed of a non-wood material;

said sublayer placed at a +22 degree angle from a horizontal direction of the upper layer;

at least one membrane located between the upper layer and the sublayer; and at least one membrane located between the sublayer and a base material.

10. The flooring system of claim 9, wherein the sublayer is composed of a material from the group consisting of rubber, plastic, composite material and polymers.

11. A method of constructing flooring system having an upper layer, a sublayer at least one membrane and at least one upper membrane, comprising the steps of:

determining a desired horizontal direction of the upper layer;

installing at least one lower membrane on a base material upon which the flooring system will rest;

installing a lower sublayer and an upper layer;

installing at least one upper membrane on top of the sublayer; and installing an upper layer of hardwood components on top of the at least one upper membrane.

12. The method of claim 11, wherein the step of installing a lower sublayer includes installing the lower sublayer at an angle with respect to the horizontal direction of the upper layer.

13. The method of claim 11, wherein the step of installing an upper sublayer further includes installing the upper sublayer at an angle with respect to the horizontal direction of the upper layer.

14. The method of claim 12, wherein the angle of the lower sublayer is +22 degrees with respect to the horizontal direction of the upper layer.

15. The method of claim 13, wherein the angle of the upper sublayer is −22 degrees with respect to the horizontal direction of the upper layer.

* * * * *